United States Patent [19]

Hutter

[11] Patent Number: 4,529,911

[45] Date of Patent: Jul. 16, 1985

[54] ABSORBER

[75] Inventor: Gerald Hutter, Höchst, Fed. Rep. of Germany

[73] Assignee: Herfurth GmbH, Fed. Rep. of Germany

[21] Appl. No.: 408,572

[22] Filed: Aug. 16, 1982

[30] Foreign Application Priority Data

Aug. 28, 1981 [DE] Fed. Rep. of Germany ..... 3134034

[51] Int. Cl.[3] ..... H01J 7/46; H01J 19/80

[52] U.S. Cl. ..... 315/39; 333/81 R; 333/251; 333/228

[58] Field of Search ..... 315/39; 333/81 R, 81 A, 333/228, 251, 151

[56] References Cited

U.S. PATENT DOCUMENTS

| | | | |
|---|---|---|---|
| 2,639,406 | 5/1953 | Crawford | 333/228 X |
| 2,644,889 | 7/1953 | Finke et al. | 333/228 X |
| 2,880,357 | 3/1959 | Snow et al. | 333/228 |
| 3,636,403 | 1/1972 | Edward et al. | 315/39.55 |
| 3,970,971 | 7/1976 | Mourier | 315/39 |
| 3,995,241 | 11/1976 | Mourier | 315/39 |

*Primary Examiner*—Saxfield Chatmon
*Attorney, Agent, or Firm*—Beveridge, DeGrandi & Weilacher

[57] ABSTRACT

For damping undesired high frequency electromagnetic oscillations on HF technology components, such as coaxial lines, waveguides and resonators, as well as for the use in resonant circuits of VHF amplifiers with high HF power electron tubes, an absorber is proposed, which can be stablely coupled in mode-selective manner, while having a negligible influence on undesired low frequency and/or other electromagnetic oscillations, whilst having a predetermined high-pass characteristic.

Absorber elements are used, which comprise a pocket made from a material having a high electrical conductivity with an opening on one longitudinal side and surrounding a ferritic, dielectric or ohmic absorber rod.

For amplifying the absorption effect and for the predetermined setting of the absorption direction, a plurality of these absorber elements can be arranged with a predetermined geometry with respect to the component generating, transporting and/or emitting the HF power.

4 Claims, 8 Drawing Figures

ABSORBER

BACKGROUND OF THE INVENTION

The present invention relates to an absorber for damping undesirable high frequency electromagnetic oscillations in HF and VHF components.

In the case of equipment for generating, amplifying and transmitting high frequency power, such as e.g. UHF power electron tubes or valves, coaxial lines, rectangular waveguides and circular resonators under certain conditions, in addition to the desired fundamental oscillation, harmonic oscillations of the fundamental and parasitic UHF oscillations also occur. Such parasitic oscillations in the UHF range can considerably impair the operation of HF equipment and must necessarily be eliminated.

Particularly in the case of large electron tubes functioning as amplifier tubes and which, due to the construction having closely juxtaposed tubular electrodes, have a considerable oscillation tendency, it is indispensible to damp the UHF oscillations.

Due to the frequency distribution of the parasitic UHF oscillation, a suitable absorber must have high-pass characteristics in a wide frequency band, must be couplable in a stable manner for UHF oscillations and to a great extent, must be direction-oriented, i.e. mode-selective in its absorptive power, so as not to simultaneously impair the useful frequency.

An absorber with high-pass characteristics is known which cannot be coupled in a stable manner. As a result, the absorber is not fully effective and the parasitic oscillations are only inadequately suppressed. In addition, this known absorber is falsely direction-oriented (mode-selective) and excludes another direction orientation due to physical laws. Thus, it is not possible to adequately absorb parasitic UHF oscillations with this known device in arrangements having high oscillation tendencies.

In other cases, it is not possible to use the absorber in the high power density range of the useful frequency due to the fact that it adversely affects the latter.

BRIEF SUMMARY OF THE INVENTION

The object of the present invention is to develop an absorber for parasitic UHF oscillations, which can be used with electron tubes having a high oscillation tendency and with coaxial lines, rectangular waveguides and circular resonators, which is constructed as a direction-oriented and stablely couplable surface absorber and which has a predetermined, freely selectable high-pass characteristic for a wide frequency band, whereby its variable construction permits adaptation to different uses.

The advantages obtained with the proposed absorber are in particular that it simultaneously has high-pass characteristics and direction orientation (mode selection). At the same time, it can be coupled in stable manner to the HF power to be damped, whilst only having a negligible influence on undesired low frequency and/or direction-oriented electromagnetic oscillations. Thus, it can be used in the range of high power densities of desired frequencies. In addition, through the mode selective surface absorber with predetermined and freely selectable high pass characteristics, parasitic UHF oscillations can be effectively damped. Finally, while the present invention has a wide variety of uses, the simple construction of and materials used in, the invention make it lead to it being less expensive.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
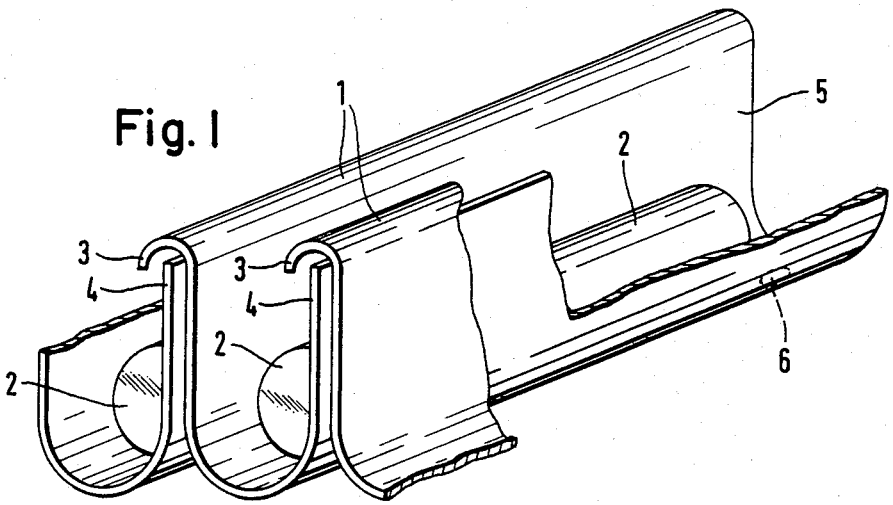
FIG. 1 is a cross-sectional view depicting adjacent absorbers in accordance with the present invention.

For damping parasitic UHF oscillations, absorber elements are proposed of the type whose construction is shown in FIG. 1. A cylindrical ferritic absorber rod 2 with a circular cross-section is placed in a sheet copper pocket 1. In the longitudinal direction the rod 2 is located in the center of the pocket 1. A plate or a liquid can be utilized in place of rod 2, and this member can be a dielectric or ohmic absorber rather than ferritic.

The pocket 1 containing the absorber rod 2 has a U-shaped cross-section, one of the legs being longer than the other and beaded over in a direction away from pocket 1. The beaded-over part 3 of the leg of a first pocket 1 is constructed in such a way that it surrounds the end 4 of the smooth leg of a second pocket 1 adjacent to the first pocket 1. Due to its U-shaped cross-section, pocket 1 has on one side an opening 5 extending over the entire length of the side through which absorber rod 2 is placed in the pocket and can be longitudinally positioned therein. Absorber rod 2 is clamped in a predetermined position by the spring tension of the leg of pocket 1. At the lowest point of the U-shaped cross-section, pocket 1 has two holes 6 through which the pocket can be secured by means of countersunk screws.

Figure 2:
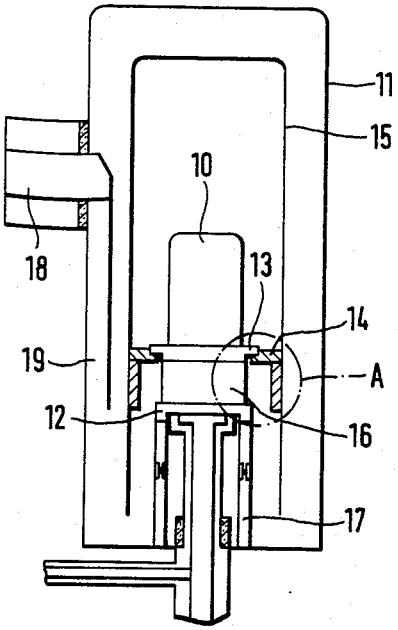
FIG. 2 is a diagram of a radio frequency final amplifier used with absorbers in accordance with the present invention.
Figure 2A:
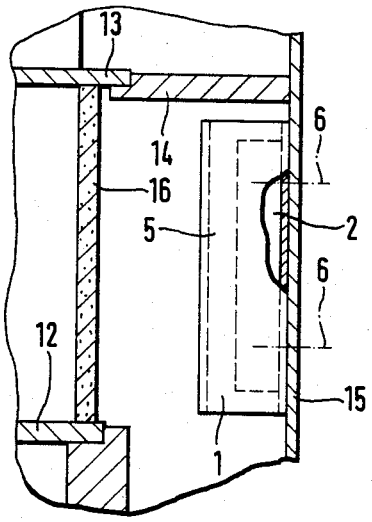
FIG. 2A depicts portion A of FIG. 2 at an enlarged scale.

An exemplified use of the proposed absorber is shown in FIG. 2 and FIG. 2A, where a radio frequency final amplifier is diagrammatically shown, being equipped with absorbers 1, 2 for damping parasitic UHF oscillations. The anode circuit of a grid-controlled power tetrode 10 comprises a folded full-wave resonator 11 coaxially surrounding the power tetrode 10. Tetrode 10 has a screen grid terminal 12 and is connected to the inner cylinder 15 of full-wave resonator 11 by means of an anode flange 13 and a support flange 14. Onto inner cylinder 15 opposite to ceramic tube 16 are secured a plurality of pockets 1 with absorber rods 2 in such a manner that their openings 5 face the adjacent ceramic tube 16 of power tetrode 10 and the parasitic UHF ocillations emitted by the same are almost completely absorbed due to the stable coupling.

The grid circuit comprises a folded λ/2 coaxial line 17, and the coupling loop for power output 18 comprises an adjustable λ/4 loop 19.

In order to bring about an amplification of more than 13 dB with an earthed grid, it is necessary to have a slope of up to 2A/V. However, this requires a spacing of less than 1 mm between the first and second grids, as well as between the first grid and the cathode in the case of an electrode having a diameter of approximately 15 cm. These are the prerequisites for self-excitation of parasitic oscillations in a frequency band of 500 to 2500 MHz. The radio frequency output amplifier used here generates parasitic oscillations particularly at approximately 750 MHz and at 1200 MHz.

Figure 3:
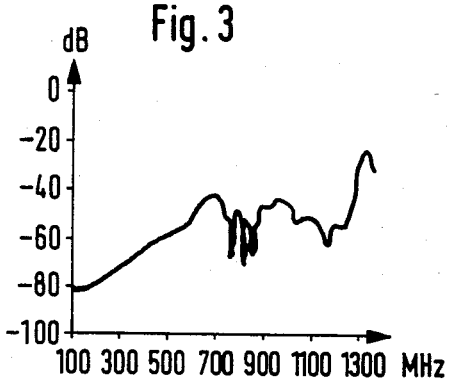
FIG. 3 depicts transmission of an amplifier tube.
Figure 4:
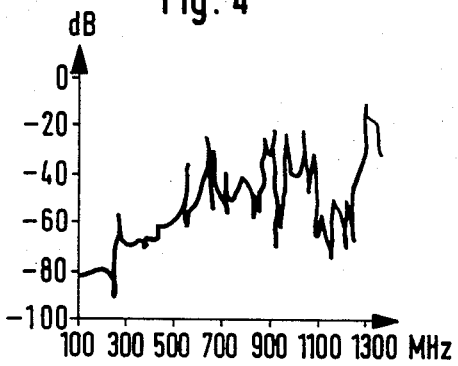
FIG. 4 depicts transmission of an amplifier tube without an absorber, arranged in a cavity, in accordance with the present invention.
Figure 5:
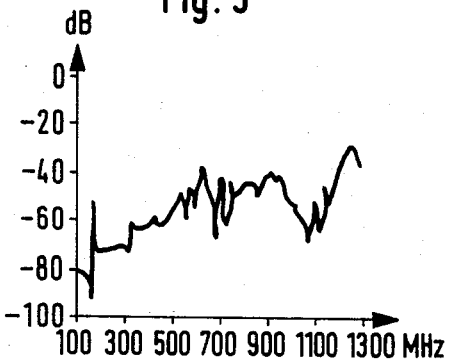
FIG. 5 depicts transmission with a ferrite absorber in accordance with the present invention.

FIGS. 3 to 5 show measuring diagrams of the transmission of the radio frequency amplifier, i.e. the damping in decibels as a function of the frequency under different boundary conditions.

FIG. 3 shows the transmission of the amplifier tube when it is arranged in the open.

The diagram of FIG. 4 shows measuring diagrams under the same marginal conditions on an amplifier tube enclosed in a cavity. Resonance spectra occur at frequencies 530, 650, 1000 and 1250 MHz.

FIG. 5 shows the influence of a high-effectivity ferrite absorber on the transmission under otherwise unchanged material conditions. The UHF resonances are damped by more than 10 dB. The absorber comprises ferrite rods directly surrounding the ceramic anode of the tube.

It is obvious that such an absorber cannot be used at frequencies with a higher energy density without further measures, so that the ferritic absorber rods 2 are partitioned by sheet copper pockets 1 and extensively surround the ceramic anode of the tube.

Figure 6:
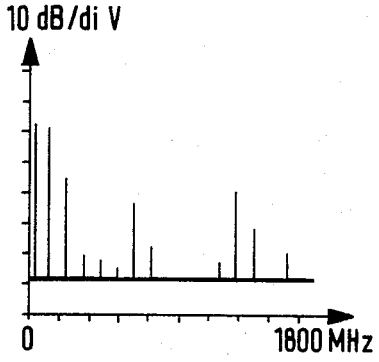
FIG. 6 depicts the harmonic and parasitic spectrum without an absorber in accordance with the present invention.
Figure 7:
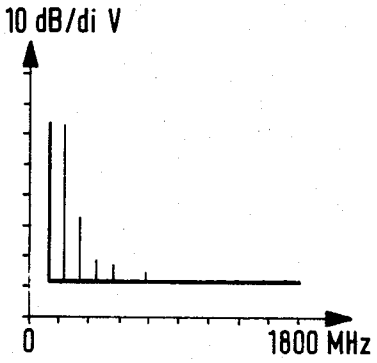
FIG. 7 depicts the harmonic and parasitic spectrum with an absorber in accordance with the present invention.

FIG. 6 shows for the fundamental oscillation of 108 MHz, the harmonic and parasitic spectrum from 0 to 1800 MHz without an absorber. Under otherwise identical conditions, FIG. 7 shows the spectrum with absorber rods 2 surrounding ceramic tube 16 in a pocket 1 acting as a mode-selective shield.

What is claimed is:

1. A mode-selective absorber having predetermined high-pass characteristics for dampening undesired high frequency electromagnetic oscillations in high frequency and very high frequency devices, comprising:

a plurality of elongated absorbing members for absorbing the undesired high frequency oscillations, and a corresponding plurality of elongated, highly electrically conductive pocket members for securing each of said absorbing members, each of said pocket members having an opening extending longitudinally along one side thereof over the entire length thereof, one absorbing member extending longitudinally in a predetermined position within each pocket member, on the side thereof remote from said opening, and facing a power-generating, transporting and/or emitting device through said opening to produce mode-selective, increased absorption of undesired electromagnetic oscillations.

2. An absorber as claimed in claim 1 in which each pocket member has a U-shaped cross-section with one leg of the U longer than the other, said longer leg being beaded-over in a direction transverse to said cross-section such that it surrounds the end of the shorter leg of a second pocket member.

3. An absorber as claimed in claim 1 in which said plurality of absorbing members and corresponding plurality of pocket members are arranged concentrically about an electron tube, with the longitudinal axes of said absorbing members parallel with the longitudinal axis of the electron tube.

4. An absorber as claimed in claim 1 in which said absorbing members are rods.

* * * * *